United States Patent [19]

Erickson

[11] Patent Number: 4,805,824

[45] Date of Patent: Feb. 21, 1989

[54] APPARATUS FOR ATTACHING CABLE TO A SURFACE

[76] Inventor: Gary W. Erickson, 819 Arthur St., Menasha, Wis. 54952

[21] Appl. No.: 59,198

[22] Filed: Jun. 8, 1987

Related U.S. Application Data

[63] Continuation of Ser. No. 782,317, Oct. 1, 1985, abandoned.

[51] Int. Cl.[4] ..... B25C 5/02; B25C 5/06; B27F 7/00

[52] U.S. Cl. ..... 227/120; 29/432; 29/798; 29/809; 206/340; 248/49; 248/71; 227/147

[58] Field of Search ..... 29/432, 798, 809; 227/147, 31, 120, 109, 121-132, DIG. 1 M, 146; 248/71, 49, 907; 411/441, 480, 544, 807

[56] References Cited

U.S. PATENT DOCUMENTS

| | | | |
|---|---|---|---|
| 2,438,361 | 3/1948 | Doblin et al. | 227/109 UX |
| 2,562,287 | 7/1951 | Webster | 227/147 X |
| 2,637,030 | 5/1953 | Weckman et al. | 227/120 X |
| 3,032,769 | 5/1962 | Palmer | 29/432 |
| 3,085,129 | 4/1963 | Anderson | 248/71 |
| 3,176,945 | 4/1965 | Anderson | 248/71 |
| 3,241,797 | 3/1966 | Anderson | 248/71 |
| 4,087,035 | 5/1978 | Harmon | 227/120 |
| 4,139,136 | 2/1979 | Catalano | 227/147 X |
| 4,389,012 | 6/1983 | Grikis et al. | 227/120 |
| 4,424,929 | 1/1984 | Weis | 227/120 X |
| 4,527,724 | 7/1985 | Chow et al. | 227/DIG. 1 M X |
| 4,537,343 | 8/1985 | Johansson | 227/120 |

FOREIGN PATENT DOCUMENTS

| | | | |
|---|---|---|---|
| 1603698 | 8/1970 | Fed. Rep. of Germany | 227/147 |
| 2035601 | 12/1970 | France . | |
| 1554602 | 10/1979 | United Kingdom . | |

*Primary Examiner*—Charlie T. Moon
*Attorney, Agent, or Firm*—Thomas D. Wilhelm

[57] ABSTRACT

Apparatus and methods for attaching cable to a surface and for thus installing the cable. Apparatus includes driving guns improved for driving fasteners through clips, and guns having the capability to selectively prevent the advance of the magazine contents, such that the gun plunger may strike a fastener more than once. Apparatus also includes driving guns having modified magazines for receiving clips and improved clips which may be loaded into the modified magazines of the guns. The clips have retainer means thereon functional for assembling the clips into a strip by engagement of the retainer means on surfaces of adjacent clips. The clips may be used with staples or nails as fasteners. The driving surface of the gun may be modified for accommodation of the combination design of clip and fastener.

5 Claims, 10 Drawing Sheets

APPARATUS FOR ATTACHING CABLE TO A SURFACE

This application is a continuation of application Ser. No. 782,317, filed Oct. 1, 1985, now abandoned.

BACKGROUND OF THE INVENTION

This invention relates generally to attachment of wire or cable to a surface. Cables and wires have achieved a position of importance in that they are used extensively in telephone, telegraph, television, and electrical power industries, and the like. In many instances the cable is attached to a surface, such as in a building, by a fastener such as a nail or staple. Typical surfaces of attachment are compatible with use of nails or staples. The earliest cable attachments might have, for example, been made by driving a nail part way into a wooden surface where the cable was to be attached, positioning the cable beside the nail, the bending the nail over the cable to hold it. The multiple steps are, of course, time consuming and, thus, costly. Another early means of attaching cable to a surface was with staples which are placed over the wire and driven into the wood, or other surface, by striking the staple with a hammer. Still another means of attaching cable is by means of driving a staple from a staple gun and over the cable, such that the gun drives the staple with a single blow much like a hammer drives the staple with multiple blows.

Staples are generally preferred over bent nails. The staples may be faster, particularly if a staple gun is used. Also the staple leaves no opening where the cable might escape the hold of the fastener. There are, however, problems with the use of staples, although the quickest attachment is done with a staple gun. Staple guns are not particularly sensitive to the deformability of the cable. The gun should exert adequate striking force to drive the staple firmly into the surface, and gently, but firmly, grip the cable. But surfaces vary in hardness, and so it is not unusual for a gun to not fully drive the staple into firm contact with the cable, as when attaching it to hardwood. Or, the gun may drive the staple so hard as to cause the staple to somewhat deform the cable. Either case presents problems with the installation. If the cable is not held firmly in place, it may be moved by wind or by accidental bumping and the like. Such movement is injurious to the cable as well as to the cable exterior. If the cable is deformed by the staple, the electrical signals being carried by the cable may be undesirably altered by virtue of the deformation in the cable.

Another problem with the use of staple guns is that, if the gun is misaligned over the cable, then the staple may cut or penetrate the cable, thereby yielding a faulty installation.

Currently, there are available protective clips with nails. The clip is emplaced by hand over the cable, and the nail, or nails, are pounded into the surface with a hammer. While this method may result in a quality installation job, it is slow as compared to a staple gun, and there is the risk of striking the cable with the hammer and damaging it. Using a staple gun is substantially faster, but the quality of the installation job may not be acceptable, due to the staple gripping the cable too tightly, or not tightly enough or penetrating the cable.

It is an object of the invention to provide an improved method of attaching cable to a surface, where the cable may be attached to surfaces representing a variety of hardnesses, and where the cable is not penetrated, and is held neither too loosely nor too tightly, but rather, firmly and gently.

It is another object to provide an improved driving gun for simultaneously driving a fastener and a clip over a cable.

It is yet another object to provide a clip which can be used in an improved driving gun, and wherein the clips may be attached to each other, by means of retainer means on the clips, to form a strip of clips.

It is still another object of the invention to provide a driving gun for simultaneously driving a clip and a pair of fasteners such as nails.

Another object of the invention is to provide a driving fun with a magazine brake in the magazine of the gun.

SUMMARY OF THE INVENTION

It has now been found that certain of the objectives are met in an improved gun for driving a fastener. The improved gun has a frame, a plunger, means for moving the plunger and driving a fastener, and a magazine. The plunger is mounted in the frame, and moveable with respect to the frame, and has a surface for driving the fastener. The magazine is dimensioned for locating and aligning the fastener and a clip in position for driving of the fastener through the clip, and into a mounting surface, by the plunger. The gun also has a slot, which may be in the magazine, aligned with the plunger, the slot being dimensioned to allow the fastener and clip to be fed into alignment with the plunger, and to exit the gun.

Preferably the slot is in the magazine, and the magazine is dimensioned for simultaneously locating and aligning the fastener and clip, with the slot being dimensioned to allow the fastener and clip to exit the magazine together.

In one preferred embodiment of the invention, the magazine has a single compartment. In another embodiment, the magazine has first and second compartments. In that embodiment, it is typical for the first overlying compartment to be sized to dimensions of the fastener and for the second underlying compartment to be sized to dimensions of the clip. It is desirable in some embodiments, though not critical, that there be included a brake in the magazine. The purpose of the brake is to selectively prevent movement of fasteners, or clips, namely the contents of the magazine, in the magazine toward the plunger. This is particularly desirable in a two compartment magazine where the brake is located in the first overlying compartment which holds the fasteners.

Another features of the invention is the incorporation on the gun, of a cable guide means for aligning the fastener and the clip over a cable. In some embodiments the cable guide means extends beyond the bottom surface of the gun, typically formed by the magazine. Also in some embodiments, the means for moving the plunger is capable of moving the plunger approximately the same distance from the magazine as the cable guide means extends from the magazine, so that the plunger may drive the fastener and clip fully onto the cable.

In another version of the cable guide means, the gun has two sidewalls which define the general thickness of the gun. The magazine has a bottom wall extending generally across the thickness of the gun and defining the bottom of the gun, and the cable guide means is comprised of a channel formed in the bottom wall. In any of its embodiments, the cable guide is used for aligning the cable channel on the clip, and, indirectly, the fastener, with the cable before driving the fastener through the clip into the mounting surface. The cable guide may, of course, be used to align the fastener directly if the clip is not used.

In the complete set-up where the gun is ready for use, the gun has a fastener and a clip in the magazine. The fastener is so superimposed over the clip as to facilitate simultaneous driving of the fastener and the clip from the magazine.

Other objectives of the invention are met in another embodiment of an improved gun for driving a fastener into a surface where the gun has a frame, a plunger, means for moving the plunger and driving a fastener, and a magazine. In this embodiment, the plunger is likewise mounted in the frame, and is likewise moveable with respect to the frame. The improvement in this gun is in having a brake in the magazine for selectively preventing movement of the fasteners toward the plunger. By being able to prevent the movement of fasteners toward the plunger, the plunger may thus be used to strike a fastener more than once to further drive it, as desired, into the surface to which it is being attached.

The guns of this invention may be used with a variety of fasteners and most specifically with staples and nails. For use with staples, the primary modification to the gun is usually in the design of the magazine. For use with nails, the driving surface may include a cut-away central portion of the plunger, and a pair of elongated drivers on either side of the cut-away portion.

Still other of the objective are met in a method of driving a fastener from a fastener driving gun, where the gun has a frame, a plunger mounted in the frame and moveable with respect to the frame, means for moving the plunger and driving the fastener with the plunger, and a magazine. The magazine is dimensioned for locating and aligning the fastener and clip in position for driving the fastener through the clip by the plunger. The gun has a slot aligned with the plunger, and the slot is dimensioned to allow a fastener and a clip to exit the gun. The steps of the method are loading, into the magazine, a fastener and a clip, aligning the fastener and clip with the plunger for driving the fastener through the clip by the plunger; and driving the fastener through the clip, by the plunger striking the fastener.

In some highly preferred embodiments of the method of the invention, and where a fastener and clip in the magazine are urged toward the slot, and toward alignment with the plunger for driving. the method includes the step of selectively preventing the movement of fastener and clip toward the slot, so that the plunger may be used to strike the fastener a second time while movement of fastener and clip toward the slot is being prevented.

Yet others of the objectives are met in a method of driving a pair of fasteners and a bridging clip with a fastener driving gun. The gun here, also, has a frame, and a plunger mounted in the frame and moveable with respect to the frame. The plunger has a driving surface for driving the fasteners, the surface including a cut-away central portion of the plunger, and a pair of elongated drivers on the plunger on either side of the cut-away portion. There is means for moving the plunger and thereby driving the fasteners, and a magazine. The gun has a slot aligned with the plunger, the slot being dimensioned to allow the pair of fasteners and the bridging clip to exit the gun together. The steps of this method are loading, into the magazine, an assembly of a pair of fasteners and a bridging clip, aligning the assembly with the plunger, and striking both of the fasteners with the plunger. The method may also include the step of the plunger striking the fasteners a second time. The method may further include the step of essentially simultaneously removing the fasteners and the bridging clip from the gun through the slot.

Other objectives are met in a method of attaching a cable to a surface using a fastener driving gun, a protective clip, and fastener means. The steps of the method are loading the protective clip and the fastener means into the gun, positioning the cable between the surface and the gun with the protective clip aligned over the cable, and striking the fastener means with the plunger, and thereby driving the fastener means into the surface. The use of this method of attaching cable has two highly beneficial advantages. First in that the fastener means remains spaced from the cable by the protective clip, thereby ensuring that the fastener means does not unintentionally penetrate the clip because of misalignment of the fastener over the cable. Second is that the clip generally absorbs any residual energy left in the fastener after it penetrates the fastening surface, and thus nullifies any tendency for the fastener to deform, or crush the cable.

Of course, a plurality of fastener means and clips may be in the magazine and are, as usual, urged toward the slot. As in the other embodiments, the method may include the step of selectively preventing the movement of the fastener means and the clips toward the slot, so that the plunger may be used to strike the fastener means a second time, and as many times as desired to complete driving it into the fastening surface.

Still other objectives of the invention are met in a protective clip. The clip has a top, a bottom, a front surface and a rear surface, and a channel between the front surface and the rear surface, for accommodating a cable. A portion of the bottom of the clip is the channel.

The clip has a first retainer means on its front surface and a second retainer means on its rear surface, the first and second retainer means being so cooperatively configured that the first retainer means on one clip may be matingly engaged with the second retainer means on another clip when the respective first and second retainer means are urged together with moderate force.

In preferred embodiments of the clip, the first retainer means is female and extends with uniform cross-section across at least a portion of the front surface between the top and the bottom of the clip. In its most preferred embodiments, the first female retainer means extends the full length of the front surface from the top of the clip to the bottom.

The clips of the invention preferably have fastener guide means, spaced from the channel, for receiving and guiding the fastener means for use with the clip. The fastener guide means is so designed as to be functional for guiding the fastener means through the clip from top to bottom. In some embodiments, the clip is used with a staple in the fastener guide means.

In other embodiments, the fastener guide means is a pair of holes extending in the direction from the top toward the bottom, and a nail is included in each hole.

The clips of the invention are preferably used as strips of clips, where the respective retainer means of adjoining clips are joined together to make the strip, with one retainer means on one clip being matingly engaged with another retainer means on another clip, such that the engagement of the one retainer means on the one clip and another retainer means on the other clip is effective hold together the two clips as an assemblage. Especially for use of the clips in strips, the first retainer means in each clip is female and extends across at least a portion of the front surface between the top and bottom of the clip.

Most preferably, female retainer means in each clip extends in full length of the front surface from the top to the bottom.

In highly preferred embodiments of clips of the invention, the second retainer means in each clip is male and extends substantially the full length of the rear surface, from top to bottom.

In the most preferred embodiments of the clips of the invention, in its use, a clip may exit the magazine by sliding through the slot, the corresponding ones of the matingly engaged retainer means being disengaged by means of sliding out of engagement.

One way of achieving the sliding disengagement is for each of the affected retainer means to have a substantially uniform cross-section along its entire length.

DETAILED DESCRIPTION OF THE INVENTION

Figure 1:
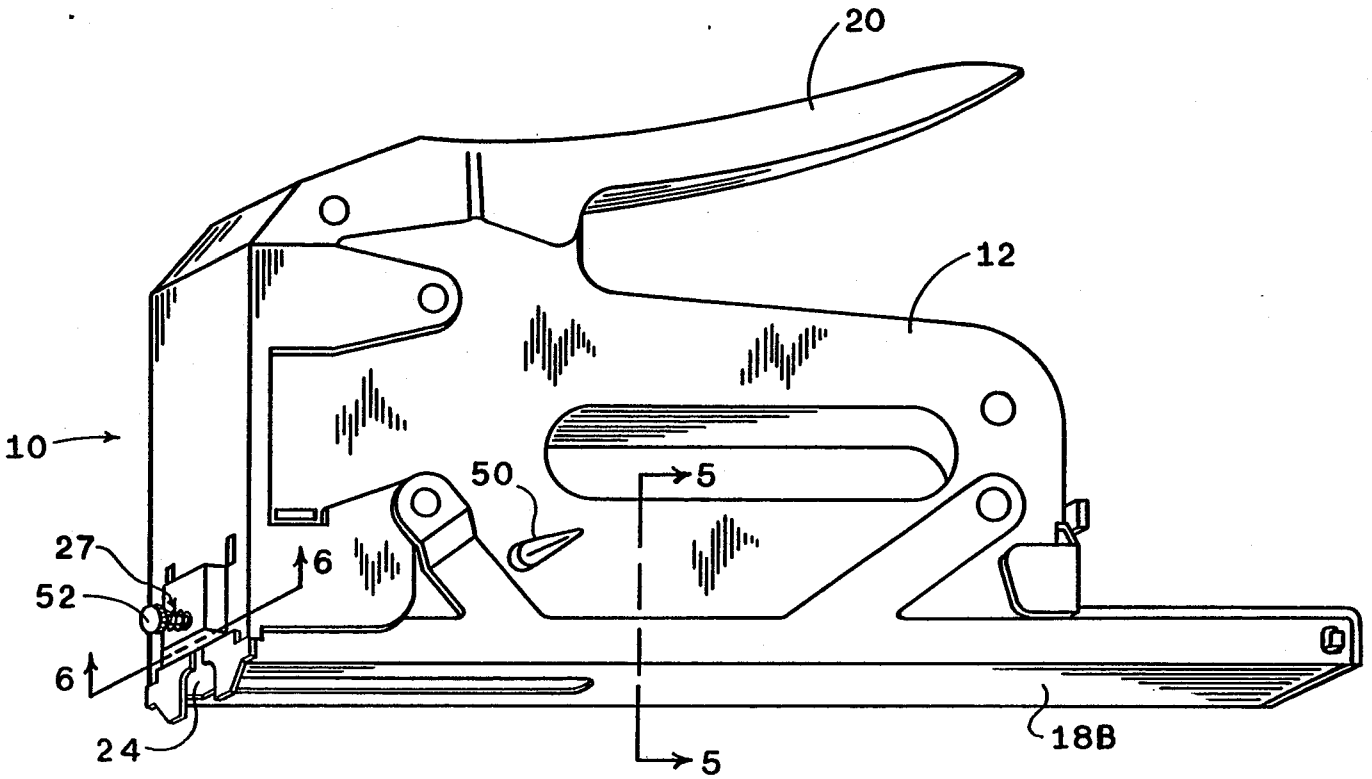
FIG. 1 is a pictorial view of one embodiment of driving guns of the invention, having a two compartment magazine.
Figure 2:
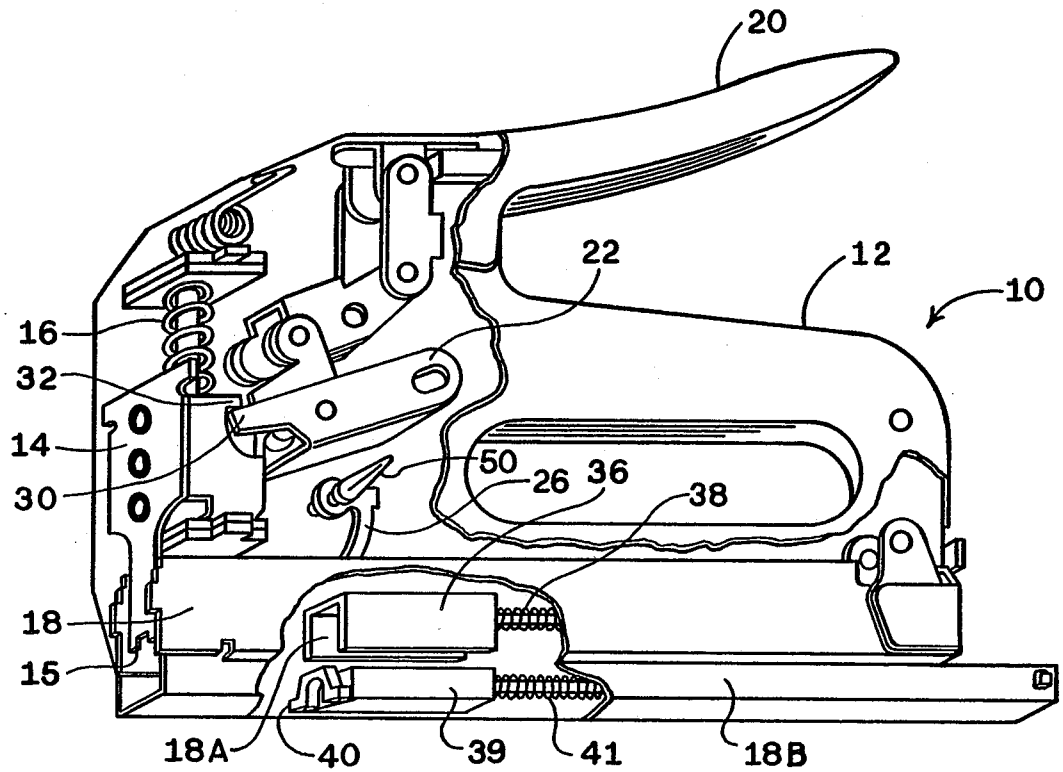
FIG. 2 is a pictorial view as in FIG. 1 with parts cut away to show interior portions of the gun.

One embodiment of the invention is seen in the gun 10 shown in FIGS. 1 through 6. Typical use of the gun is for driving fasteners into a surface, such as wood or masonary. Typical fasteners used with guns of the invention are staples and nails.

The gun 10 has a frame 12, a plunger 14, a drive spring 16, a magazine 18, a handle 20, a linkage 22 between handle 20 and plunger 14, a cable guide 24, and magazine brakes 26 and 27.

Frame 12 generally forms the outer surface of the gun and serves as the structure to which the several other parts are mounted. Likewise, the moving parts of the gun are seen as moving with respect to frame 12.

Plunger 14, also known as a hammer, is used for striking a fastener, or fasteners, with substantial force by means of its driving surface 15, in order to drive it/them into a surface and thus achieve attachment to the surface. The basic working principle is that an object may be imposed between the fastener and the surface, such that when the fastener is driven into the surface, it is simultaneously urged against the object, thereby holding the object to the surface. Thus are cables and the like attached to various surfaces for installation of various electronics based systems, such as cable television, telephone, telegraph, computer cables, fiber optic cables, etc.

The force for driving plunger 14 is provided by driving spring 16, which is compressed by the raising of plunger 14 when handle 20 is moved downward by the squeezing of the user's hand in the conventional way. As the handle is moved downwardly, lifting finger 30 on linkage 22 lift the plunger by sliding engagement with tabs 32 on plunger 14, compressing driving spring 16 as the plunger is lifted, thereby creating an internal driving force potential within the driving gun. As the plunger is further lifted, the fingers 30 slide out of engagement with tabs 32, releasing the force of compressed driving spring 16 to drive plunger 14 downwardly with substantial force. Thus is the time period of transferring driving energy into the gun substantially different from the time period of release of the energy to the plunger to drive the staple and clip.

As plunger 14 moves downwardly it strikes a staple 34, which has been aligned in the first compartment 18A of the magazine 18 at the urging of follower 36 and follower spring 38. Plunger 14 strikes staple 34, driving it downwardly into clip 40 in the second compartment 18B. Clip 40 is previously aligned by the urging of follower 39 and follower spring 41. Clip 40 preferably has holes 42, for accepting the staple 34. At this point the staple 34 and slip 40 have been joined together to form a protective fastener means, the joinder being part of the method of driving the staple.

In the embodiment seen in FIGS. 1–6, the length of the stroke on the plunger 14 is such that the staple 34 is driven through the clip 40 and the staple-clip combination is driven partially out of magazine 18 as it grips the cable 43 and holds it to surface 44. With the clip 40 still partially in the magazine 18, as in the embodiment of FIGS. 1–5, it prevents the advance of the next clip into alignment with the plunger 14, so long as the gun remains on surface 44. Brakes 26 and 27 may be separately and individually activated by moving their external control levers 50 and 52 in the direction as shown, to temporarily prevent advance of clips and staples and particularly the leading clip and the leading staple, into alignment with plunger 14. While the advance of clips and staples is thus prevented, the handle 20 may be squeezed repeatedly with the gun still in position over the driven staple 34 and clip 40, thus striking the staple again and again, as needed to drive it further into surface 44. This repeat strike feature is especially advantageous for use on hard surfaces such as on masonary and on the harder woods such as oak.

Similarly, the brake 27 in the second compartment 18B may be activated while brake 26 in the first compartment 18A is released, such that a staple 34 may be advanced under the plunger 14 and driven alone, without a clip if so desired, while the brake 27 is holding the clips 40 from being aligned for driving.

Thus either of brakes 26 and 27 may be used selectively, or not, as the user so chooses, to achieve the multiple strike capability, or the capability to drive a staple without a clip even though clips are loaded into the magazine and are being urged into alignment with the plunger by follower 39 and spring 41.

Another embodiment of the invention is seen in FIGS. 7–10. In this embodiment, magazine 18 has a single compartment which is sized to hold a combination which is a clip with a fastener at least partially engaged in it. As shown, a pair of nails 54 is used as fasteners. Staples are, of course, also acceptable, as would be any functional fastener which can be driven. In order to accomodate the driving of nails, the plunger may optionally have a central portion 56 of the driving surface 15 cut away so that the essentially matched thus elongated drivers 58 may drive the essentially matched nails 54 below the surface of the clip 40 without the impediment of the central portion of driving surface 15 striking the top of the clip 40.

When the central portion 56 of the driving surface 15 is cut away, it is preferred that plunger 14, and particularly the driving surface 15 be made from hardened metal, to make up in metallurgical properties for the reduction in structural strength provided by dimensional sizing. Brake 26 is typically as described and shown for the first embodiment of FIGS. 1–6.

Figure 18:
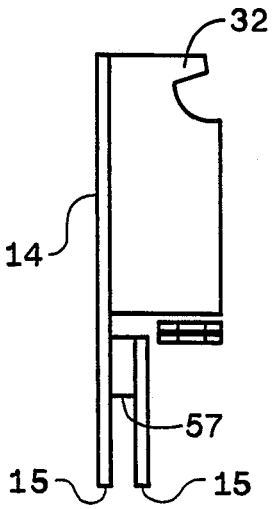
FIG. 18 shows a side view of a plunger having a second striking surface.

In another embodiment, as seen in FIG. 18, the plunger 14 may have a second striking surface offset front to rear from the first striking surface, for simultaneously driving a second staple or a second pair of nails. The offset of the second striking surface may be accomplished, for example, as by spacer 57. Clearly, a plurality of fasteners may be driven simultaneously if the plunger is driven with sufficient force and is properly aligned with the fasteners.

Figure 3:
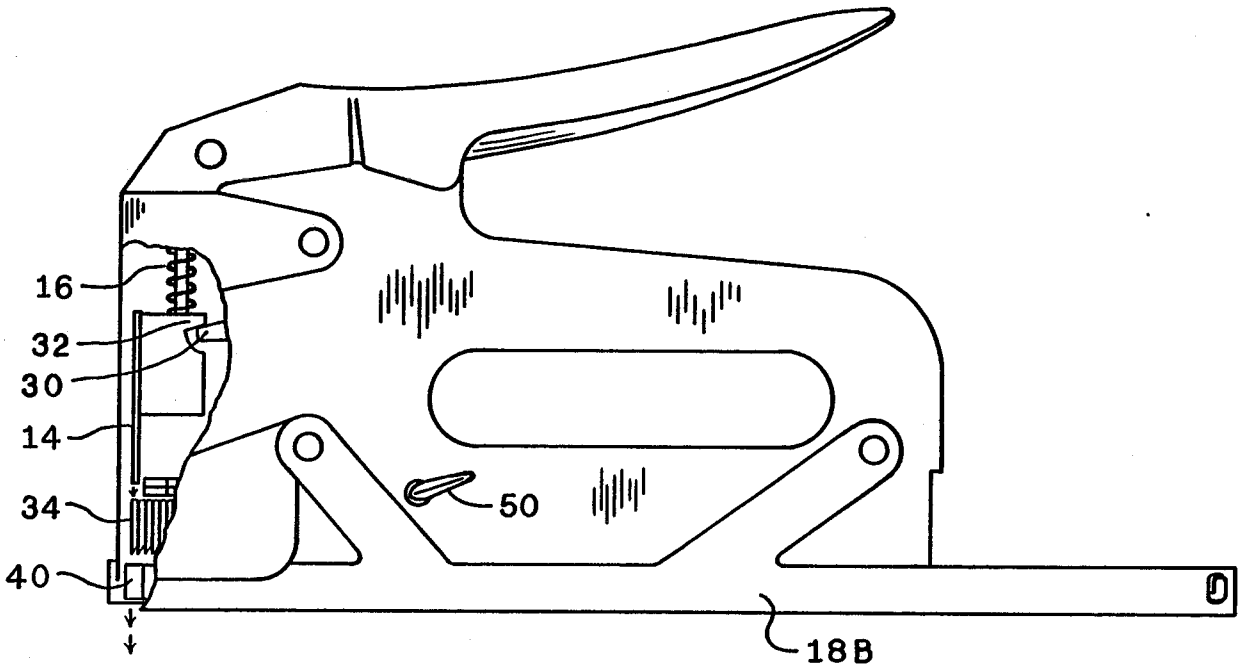
FIG. 3 is an enlarged side view of a gun as in FIG. 1, with a portion cut away, and showing the alignment of the plunger, the fastener, and the clip.
Figure 4:
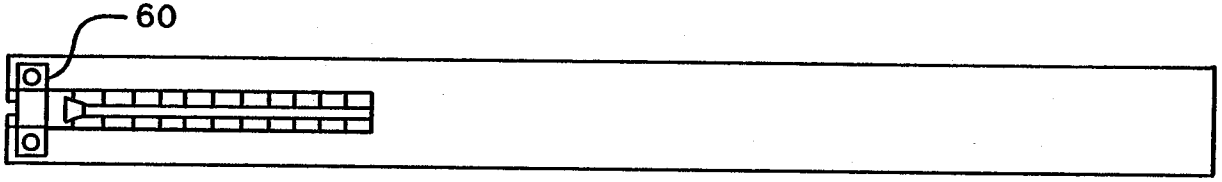
FIG. 4 is a view of the bottom of the gun as in FIG. 1 and shows the slot in the magazine through which the clip and staple exit the gun.
Figure 6:
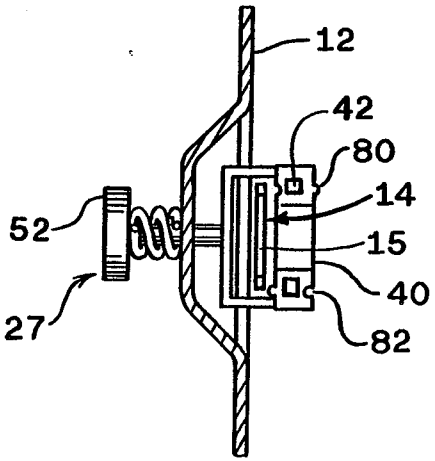
FIG. 6 is a cross-section taken at 6—6 of FIG. 1, of the brake for the lower magazine.
Figure 5:
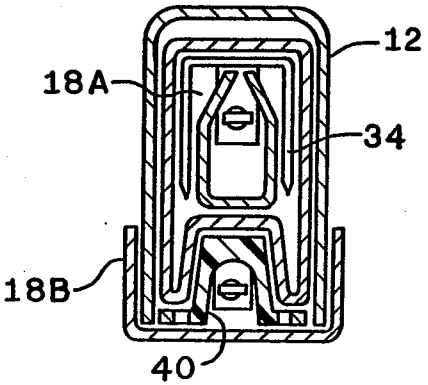
FIG. 5 is a cross-section taken at 5—5 of FIG. 1, and showing the relationship of the two magazine compartments to each other.
Figure 7:
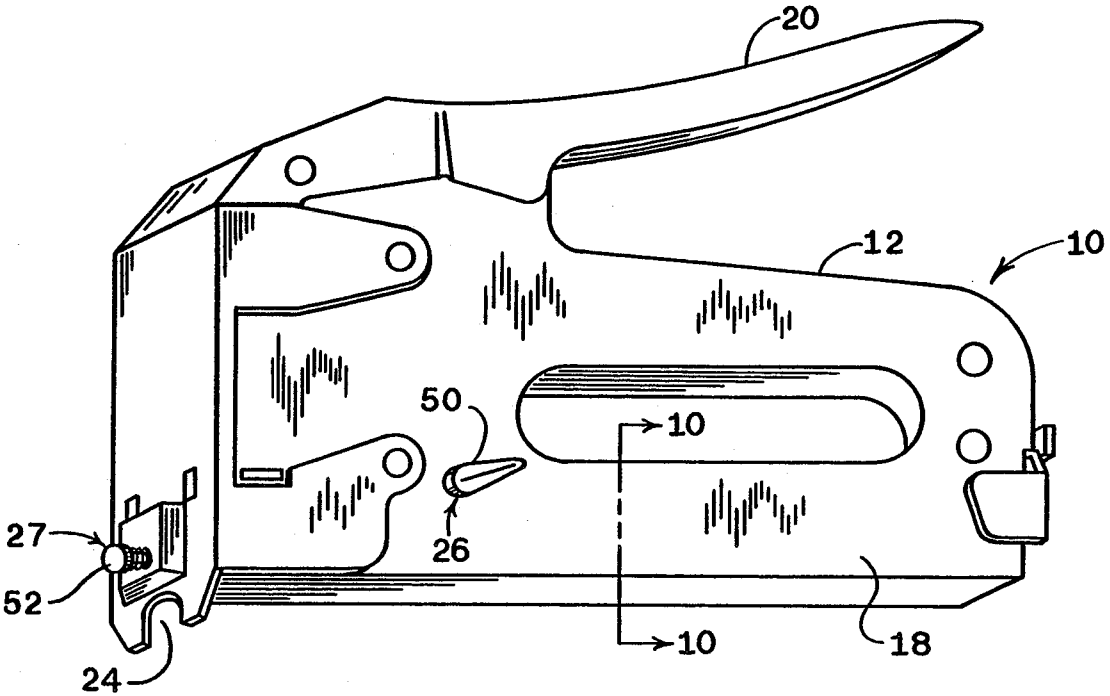
FIG. 7 is a pictorial view of a second embodiment of driving guns of this invention, having a single compartment, a modified magazine, and a modified plunger.
Figure 8:
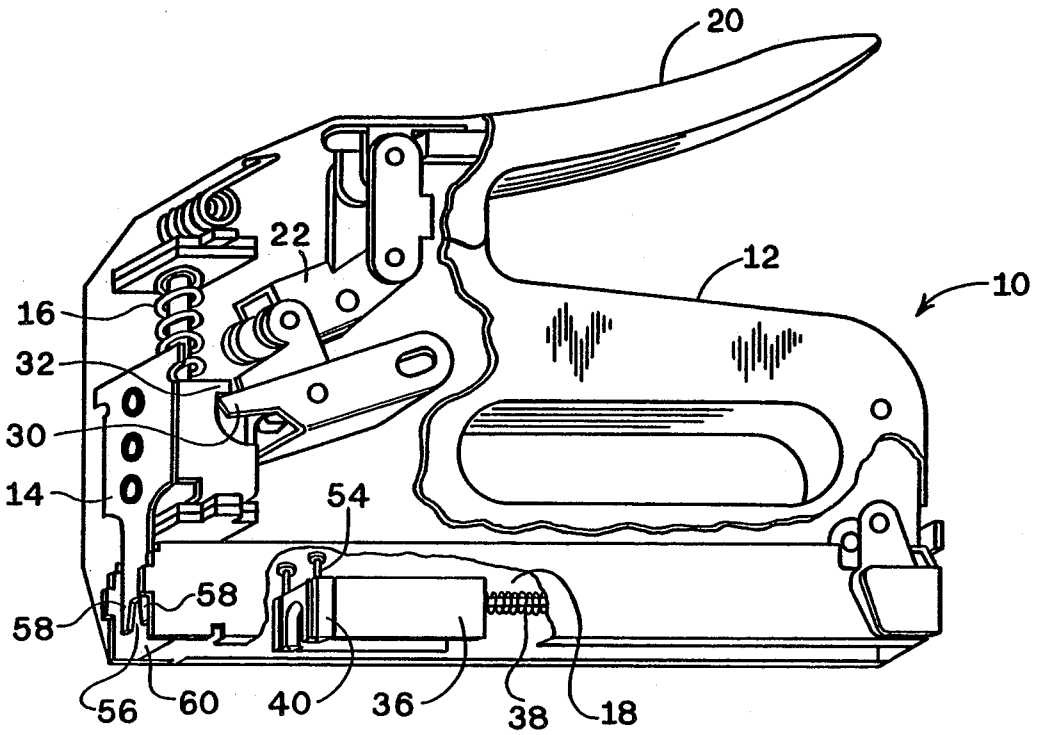
FIG. 8 is a pictorial view as in FIG. 7 with parts cut away to show interior portions of the gun.
Figure 9:
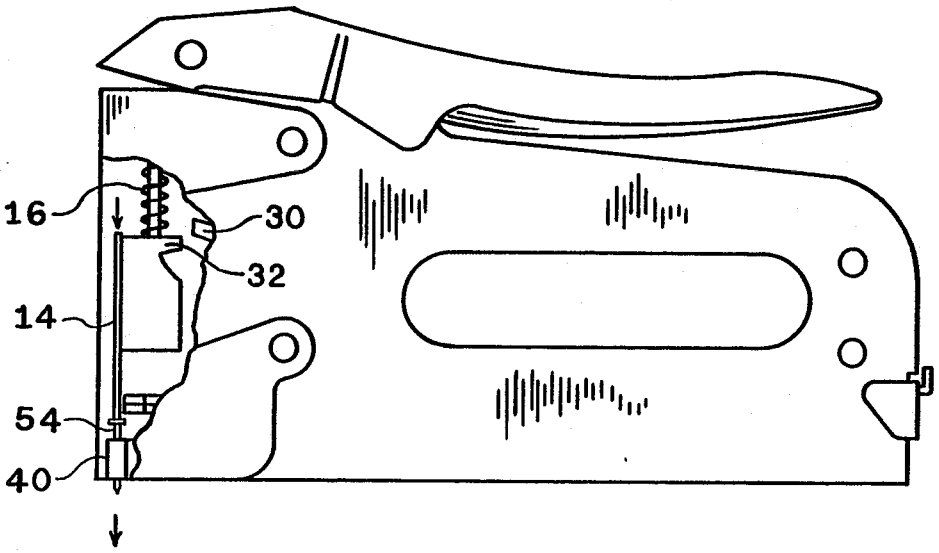
FIG. 9 is an enlarged side view of a gun as in FIG. 7, with a portion cut away, and showing the alignment of the plunger, the fastener and the clip.
Figure 10:
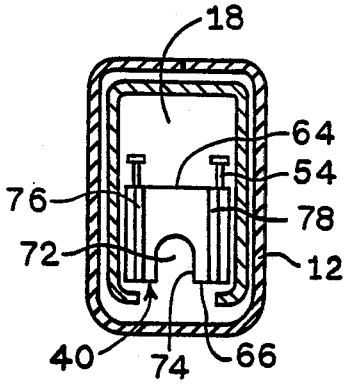
FIG. 10 is a cross-section taken at 10—10 of FIG. 7 showing interior cross-section of the magazine.

In any of the embodiments of the guns of the invention for use with clips, the magazine 18 is generally oversized with respect to the fastener, whether staples 34 or nails 54, and whether having a single compartment or two compartments. In the two compartment magazine as in FIGS. 1–6, the first compartment 18A for holding the staples 34 is of a conventional design. The second compartment 18B is for holding clips 40. It has its own follower 39 and follower spring 41 for urging the clips 40 toward alignment with the plunger. As is seen in FIGS. 3–5, the clip 40 is both wider, left to right, and longer, front to rear, than staple 34. Thus, in order for the clip to be properly aligned under plunger 14, so that the staple 34 will be driven through it, the second compartment 18B is sized and positioned according to the dimensions of the clip. Thus the leading edge 57 of the second compartment is off-set forwardly in front of the plunger 14, so that, when the clip is positioned against the leading edge 57, its fastener receiving holes 42 are aligned under the plunger 14.

The magazine 18 has a slot 60 through which the fasteners and clips exit the magazine, and thus the gun, when driven by the plunger. In some cases, the fastener is driven through the clip and into the surface without necessarily moving the clip out of the magazine and gun. In these cases, the clip-fastener combination leaves the gun as the gun is lifted from the surface. In other cases the gun may shoot the clip-fastener combination through slot 60 and out of the gun at the strike of the plunger. In the latter cases, the length of the stroke of the plunger is designated such that the distance of travel of the plunger is adequate to move the clip-fastener combination the desired distance.

Cable guide 24 is used to align the gun over a cable preparatory to driving a clip-fastener combination over the cable. In some cases, the cable guide 24 may be recessed into the lower part of magazine 18. In other, and more preferred cases, the cable guide 24 extends somewhat beyond magazine 18, in which case it is desirable that the clip-fastener combination be driven at least part way out of the gun through slot 60 by the action of the plunger 14. In these latter cases, the length of the stroke of the plunger is designed to assure adequate distance of driving the plunger, such that, typically, the striking surface of the plunger may be capable of moving out from the magazine a distance approximately the same as the distance the cable guide 24 extends beyond the magazine.

In preferred embodiments, the clip and fastener, or fasteners, are pre-assembled before being loaded into the gun, and the gun has a single compartment magazine. In other embodiments alignment of the clip and fastener takes place in the magazine by having the fastener superimposed over the clip, usually immediately prior to the fastener being struck by the plunger and driven through the clip.

The most preferred use of the invention is a method of driving fasteners, such as nails or staples for use in attaching cable to a surface and, specifically for installing cables onto wooden surfaces as in cable television installation.

In order to be operable in guns of the invention, clips need only be sized cooperatively with magazine 18 and slot 60 so that they can be properly fed and aligned in the magazine for driving and for exiting the gun through slot 60.

Figure 17:
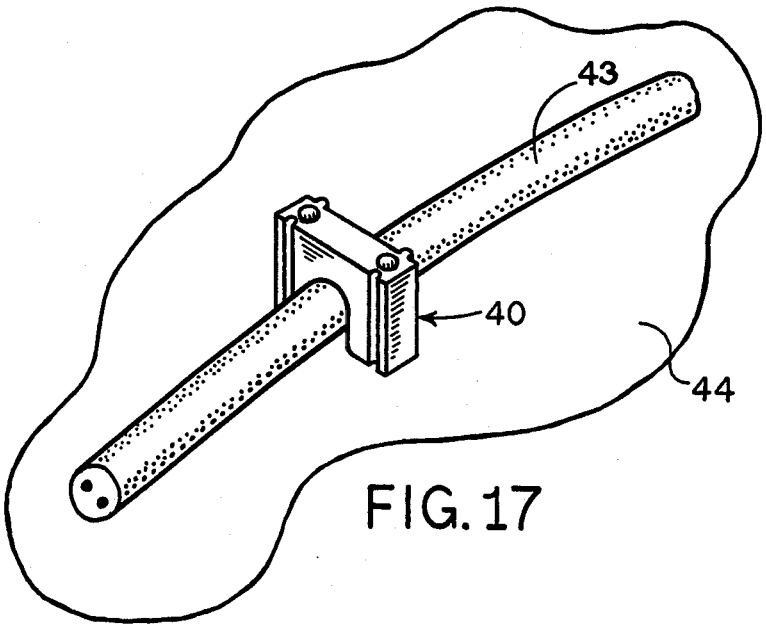
FIG. 17 is a pictorial view showing a typical installation where a cable is attached to a surface by clips and fasteners.

Another aspect of the invention is in improved clips, as seen in FIGS. 11–14. A clip 40 has a top 64, a bottom 66, a front surface 68, a rear surface 70 and a channel 72 between the front and rear surfaces 68 and 70 for accommodating a cable as seen in FIG. 17. The surface 74 of channel 72 is considered part of bottom 66. First retainer means 76 is on the front surface 68 and second retainer means 78 is on the rear surface 70. The first and second retainer means 76 and 78 are configured as compatible female and male interlocking members. The male ridge 80 on second retainer means 78 of one clip may be urged into the female channel 82 on first retainer means 76, on another clip, the first and second retainer means 76 and 78 being so cooperatively configured as to matingly engage and join under moderate force. Male ridge 80 is larger in width cross-section than is the narrowest portion of channel 82 adjacent surface 68. Thus, when ridge 80 is engaged in channel 82, the retainer means 76 and 78 tend to hold the clips together, with a sufficiently firm cooperative engagement as to prevent the accidental sliding apart of the engaged retainer means. Similarly a strip of clips may be so assembled, so that the clips may be handled and inserted into the magazine with the efficiency associated with handling the entire strip at once, rather than one clip at a time.

FIGS. 15A–15E illustrate alternate designs of retainer means which function similarly.

Figure 15A:
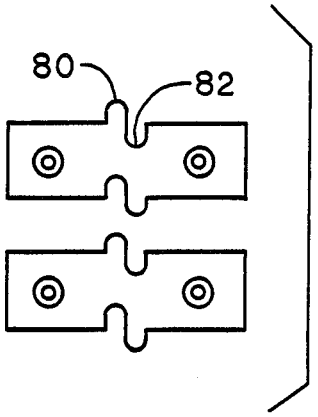
FIGS. 15A–15E are top views of the clips showing various exemplary and alternate retainer means designs.

FIG. 15A shows clips each having mirror imaged male-female combinations of retainer means adjacent each other.

Figure 15B:
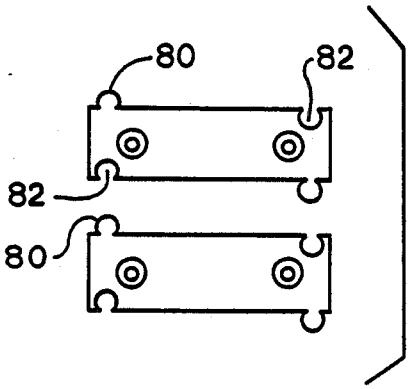

FIG. 15B shows the clips each having mirror imaged male-female combinations of the retainer means separated by like distances.

Figure 15C:
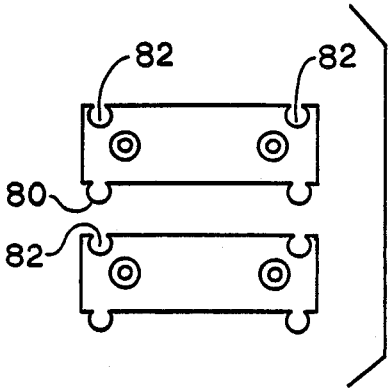

FIG. 15C shows the clips having two retainer means on each surface, where one surface has two male retainer means and the other surface has two female retainer means.

Figure 15D:
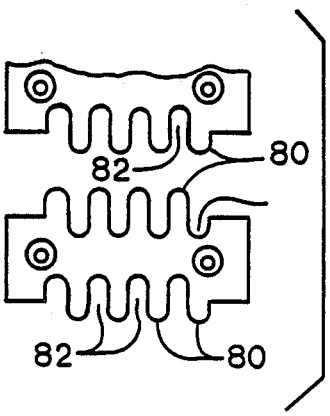

FIG. 15D shows a more or less alternating male and female retainer strip along a substantial portion of each surface of the clip.

Figure 15E:
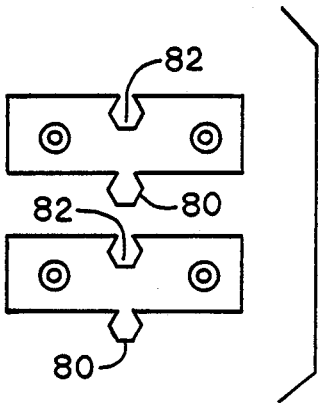

FIG. 15E shows a male-female combination where the retainer means surfaces have straight lines and straight angular surfaces, which straight angles and surfaces may be incorporated into other designs.

Among the retainer designs, it is preferred that all retainer means surfaces be the same, so that the clips need not be assembled in an particular front-to-rear arrangement—but rather front and rear are equal and thus are interchangeable. Therefore, among the embodiments illustrated, those of FIGURES 15A, 15B, and 15D are preferred.

It is preferred that both first and second retainer means 76 and 78 have approximately uniform cross-sections, from the top of the clip to the bottom of the clip, especially the female portions of any retainer means. In some cases, uniform cross-section for part of the top-to-bottom length of the clip surface is adequate. In other cases, it is better, and indeed it is preferred, that the uniform cross-section be the full length of the retainer means. Nonetheless, either or both of the retainer means may be of non-uniform cross-section and still be functional for engagement for loading into the gun and disengagement for exiting the gun through the slot.

Figure 11:
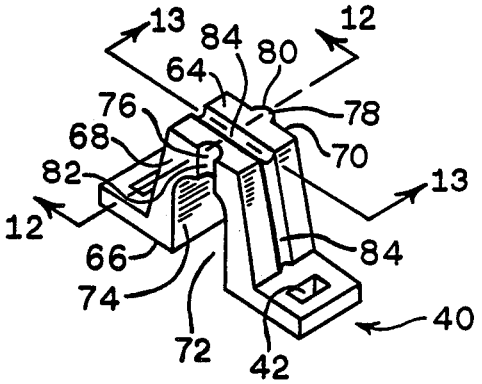
FIG. 11 is a pictorial view of a typical clip of the invention.
Figure 12:
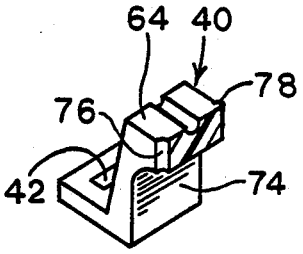
FIG. 12 is a cross-section of the clip of FIG. 11, taken at 12—12 of FIG. 11.
Figure 13:
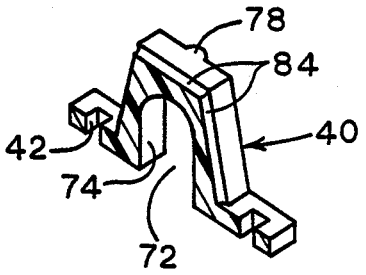
FIG. 13 is a cross-section of the clip of FIG. 11, taken at 13—13 of FIG. 11.
Figure 14:
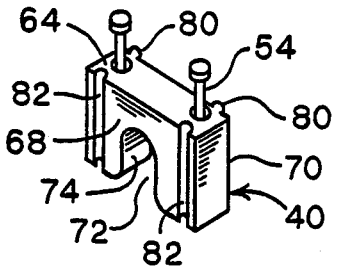
FIG. 14 shows a pictorial view of another preferred clip of the invention.

Most preferred clips have guides for the fastener or fasteners. FIG. 11 shows an exemplary clip with a staple where the clip has guide holes 42 along its sides for guiding the points and legs of a staple, while the top and sides have grooves 84 for guiding the staple. FIG. 14 shows an exemplary clip with a pair of nails. Holes 42 are sized and positioned for receiving the nails 54. Whether a clip is designed and positioned for use with nails or staples, the guides direct the fastener such that it is spaced from the cable, and the cable is thus protected from direct contact with the fastener, by the intervening portions of the clips 40.

In another aspect the invention is seen in a pair of nails 54 and a bridging clip, and wherein a primary function of the clip is to serve as a bridge to and orient a pair of nails at a selected distance apart, determined by the bridge.

Figure 16:
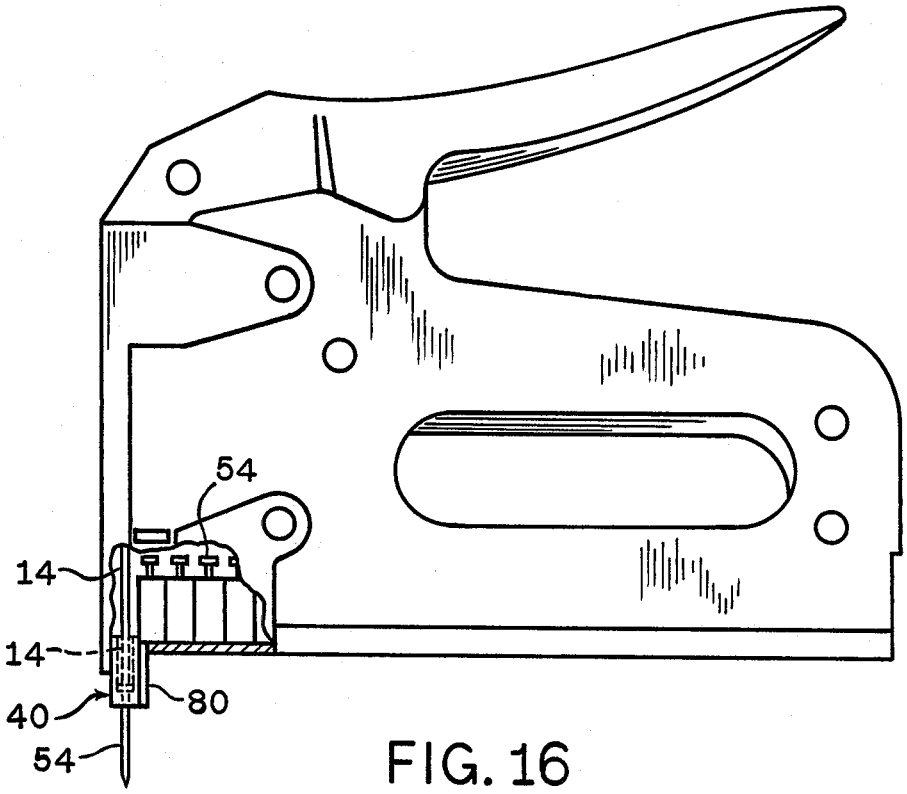
FIG. 16 is an enlarged cross-section of a partial view of a gun such as in FIG. 3 and showing the clip sliding out of engagement from the adjoining clip.

In performance of a method of the invention, a strip of clips is loaded into the magazine of a gun, with fasteners, the clips being optionally joined together by the respective retainer means. As the leading clip, which is aligned with the plunger, is driven from the gun, it accordingly disengages from the adjacent clip in the strip by sliding out of engagement, as is illustrated by FIG. 16.

FIG. 17 shows a part of a finished installation where a cable is attached securely to the surface, and where the clips 40 hold the cable firmly while protecting it from being deformed or penetrated by the fastener.

The guns of the invention have been described as being powered by a action of the driving spring, compressed by the user's hand. The gun can be adapted for use with other power sources, such as electricity or compressed air.

Fasteners and driving force may be adapted according to any specific situation. For driving into harder surfaces, greater driving force may be desired. Concurrently, harder fasteners may be used where more force is to be exerted as, for example, in masonary applications (i.e. fasteners harder than those used in wood applications).

Thus it is seen that the invention provides improved driving guns for driving fasteners and clips. The improved guns may include cable guides and magazine brakes, as well as redesigned magazines and plungers.

The invention also provides improved clips which may be assembled together in strips, loaded into the gun, and driven from the gun with the fasteners in place.

In another aspect, the invention is the combination of the novel gun with the novel clips and fasteners loaded in the magazine.

Finally, the invention resides in the novel and unobvious and substantially more efficient methods of shooting clips and fasteners and of attaching cable.

The descriptions of the illustrated embodiments are exemplary only and are not meant to be limiting. Thus the invention is to be interpreted in accordance with the following claims.

Having thus described the invention, what is claimed is:

1. As an article of manufacture, a gun for driving fastener means comprising a clip and at least one nail fastener, and said gun having a bottom surface, and comprising:

(a) a frame;

(b) a plunger mounted to said frame and moveable with respect to said frame, said plunger comprising a plunger body and a driver extending from said plunger body, for driving fastener means, for attachment of fastener means to a substrate;

(c) means for moving said plunger and driving said fastener means;

(d) a single magazine adjacent said bottom surface of said gun, for locating and aligning said fastener means, and for movement of said fastener means into alignment with said plunger; and (e) a brake in said magazine, said brake being functional for moving a leading fastener means in said magazine out of alignment with said driver, said brake being functional for moving the leading fastener means out of alignment with said driver, such that said gun can be repositioned over a previously partially set fastener means and said driver can be used to re-drive the previously partially set fastener means.

2. As an article of manufacture, a gun as in claim 1, said plunger comprising a plunger body and a pair of identical, spaced, elongated drivers extending from said plunger body for driving pairs of nail fasteners.

3. As an article of manufacture, a gun as in claim 2, said means for moving said plunger being capable of moving a portion of said drivers of said plunger beyond said bottom surface.

4. As an article of manufacture, a gun as in claim 1 and wherein said plunger includes a plunger body and a pair of elongated drivers, comprising a first striking surface, extending from said plunger body, and a second striking surface offset, front to rear, in said gun for driving of second nail fasteners simultaneously with the driving of said nail fasteners in said fastener means, the spacing between said first and second striking surfaces being greater than a transverse dimension of said nail fasteners, said first and second striking surfaces being capable of performing substantially identical functions on fasteners, such that a given fastener is acted upon by one of said striking surfaces and is not acted upon by the other of said striking surfaces.

5. As an article of manufacture, a gun for driving fastener means, said gun comprising:

(a) a frame;

(b) a plunger mounted to said frame and moveable with respect to said frame, said plunger having fastener driving means for driving said fastener means;

(c) means for moving said plunger and driving said fastener means;

(d) a magazine, said magazine being dimensioned for locating and aligning a fastener means, including a protective clip, in position for driving of the fastener means by said plunger; and (e) a brake in said magazine, said brake being functional for moving a leading fastener means in said magazine out of alignment with said plunger, said brake being functional for moving the leading fastener means out of alignment with said driver, such that said gun can be repositioned over a previously partially set fastener means and said driving means can be used to redrive the previously partially set fastener means.

* * * * *